US008277193B1

(12) United States Patent
Brostmeyer et al.

(10) Patent No.: US 8,277,193 B1
(45) Date of Patent: Oct. 2, 2012

(54) THIN WALLED TURBINE BLADE AND PROCESS FOR MAKING THE BLADE

(75) Inventors: Joseph D Brostmeyer, Jupiter, FL (US); William L Plank, Tequesta, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 145 days.

(21) Appl. No.: 12/957,488

(22) Filed: Dec. 1, 2010

Related U.S. Application Data

(63) Continuation of application No. 11/655,705, filed on Jan. 19, 2007, now abandoned.

(51) Int. Cl.
*F01D 25/14* (2006.01)

(52) U.S. Cl. ..... 416/223 A; 416/232; 416/233; 29/889.721

(58) Field of Classification Search ..... 416/223 A, 416/232, 233; 29/889.7, 889.72, 889.721
See application file for complete search history.

(56) References Cited

U.S. PATENT DOCUMENTS

| | | | | |
|---|---|---|---|---|
| 3,260,505 | A * | 7/1966 | Ver Snyder | 416/179 |
| 4,358,882 | A * | 11/1982 | Wilkinson | 29/889.721 |
| 4,631,092 | A * | 12/1986 | Ruckle et al. | 148/538 |
| 5,193,314 | A * | 3/1993 | Wormley et al. | 451/5 |
| 5,348,446 | A * | 9/1994 | Lee et al. | 416/241 R |
| 5,640,767 | A * | 6/1997 | Jackson et al. | 29/889.721 |
| 6,158,961 | A * | 12/2000 | Kehl et al. | 416/193 A |
| 6,626,230 | B1 * | 9/2003 | Woodrum et al. | 164/516 |
| 6,805,535 | B2 * | 10/2004 | Tiemann | 416/233 |
| 6,959,572 | B2 * | 11/2005 | Lawrence et al. | 72/31.03 |

* cited by examiner

*Primary Examiner* — Igor Kershteyn
(74) *Attorney, Agent, or Firm* — John Ryznic

(57) ABSTRACT

A thin wall turbine blade used in a gas turbine engine, in which the blade is cast in conventional grain from a super alloy using the lost wax process as a single piece, and then the blade walls are machined to remove enough material to leave a thin wall. The blade is cast with a wall thickness greater than the designed for thin wall in order that any core shifting during the casting process will be accounted for in the machining process. prior to machining, a scanning process is used to measure the actual wall thickness on all portions of the blade wall in order to determine how much material must be removed to leave the blade wall with the proper thinness.

11 Claims, 2 Drawing Sheets

THIN WALLED TURBINE BLADE AND PROCESS FOR MAKING THE BLADE

CROSS-REFERENCE TO RELATED APPLICATIONS

This application is a CONTINUATION of U.S. patent application Ser. No. 11/655,705 filed on Jan. 19, 2007 and entitled THIN WALLED TURBINE BLADE AND PROCESS FOR MAKING THE BLADE.

GOVERNMENT LICENSE RIGHTS

This invention was made with Government support under contract number FA8650-07-C-2803 awarded by the US Air Force. The Government has certain rights in the invention.

BACKGROUND OF THE INVENTION

1. Field of the Invention

The present invention relates generally to fluid reaction surfaces, and more specifically to a process for making a thin walled turbine blade.

2. Description of the Related Art Including Information Disclosed Under 37 CFR 1.97 and 1.98

Turbine airfoils, rotor blades and stator vanes, used in a gas turbine engine require internal cooling because of the extremely hot gas flow passing over the airfoil surface of these airfoils. Turbine airfoils have a rigid internal web or rib portion with a thin airfoil wall forming the airfoil surface on which the hot gas flow is exposed. Thin wall airfoils are used in the lower stages of the turbine that require longer airfoils, and therefore a more rigid internal structure to support the airfoil under the high stress levels during operation of the turbine. The internal ribs form the internal cooling passages and impingement cavities. Thin wall airfoils provide a high level of heat transfer from the hot external surface to the cooled interior surface of the wall.

A thin wall turbine blade made from a super alloy, such as a nickel based super alloy, cannot be cast by the conventional lost wax casting process. Wall thicknesses required for a thin wall turbine blade cannot be cast because the molten metal is not viscous enough to pass through all of the narrow cavities that form the thin walls. The prior art thin wall turbine blades are therefore made by other processes such as that disclosed in U.S. Pat. No. 6,805,535 B2 issued to Tiemann on Oct. 19, 2004 and entitled DEVICE AND METHOD FOR PRODUCING A BLADE FOR A TURBINE AND BLADE PRODUCED ACCORDING TO THIS METHOD in which the blade is cast as two halves, and then the two halves are bonded tog ether to form the finished thin wall blade.

Another process for making thin wall turbine blades is disclosed in the U.S. Pat. No. 5,640,767 issued to Jackson et al on Jun. 24, 1997 and entitled METHOD FOR MAKING A DOUBLE-WALL AIRFOIL which shows the blade made from a partially hollow airfoil support wall, and a thin wall airfoil shaped outer surface bonded over the support wall. This type of thin wall blade is a composite blade.

Another type of composite turbine blade is shown in U.S. Pat. No. 5,348,446 issued to Lee et al on Sep. 20, 1994 and entitled BIMETALLIC TURBINE AIRFOIL which shows the blade made from a core body with first and second panels bonded to the pressure and suction sides of the core body and fabricated leading and trailing edge components bonded to the leading and trailing edges of the core body to form the composite blade. All of these above cited prior art references disclose a process for making a blade in which the blade is formed of multiple parts and not cast as a single piece.

The current casting process to produce a turbine blade will produce wall thickness based on the casting alloy used and the grain structure desired. The single crystal casting process will produce a thin wall turbine blade. However, this process is very expensive to produce a turbine blade.

It is an object of the present invention to produce a turbine blade with a thin wall airfoil surface by casting the blade as a single piece without forming the blade from a plurality of parts that are bonded together.

Another object of the present invention is to produce a thin walled turbine blade that is much lower in cost than the single crystal cast turbine blade of the prior art.

BRIEF SUMMARY OF THE INVENTION

The present invention is a turbine blade for use in a gas turbine engine, in which the turbine blade has a thin wall airfoil surface for improved cooling of the airfoil wall. The blade is first cast from a super alloy by a conventional lost wax casting process with the internal cooling passages formed therein, and where the blade walls are cast with an extra thickness in order to allow for the casting process to form the blade as a single piece. The cast blade is then machined to remove wall material to the depth originally designed for the thin wall airfoil. Prior to machining the extra thick wall blade, the wall thickness is measured around the entire blade to determine how much material must be removed in order to leave the wall with the proper thickness in order to account for core shift during the casting process. The cost of casting a thick walled super alloy turbine blade and then machining the walls to the desired thinness is much lower than the cost of casting a single crystal thin wall turbine blade.

DETAILED DESCRIPTION OF THE INVENTION

The present invention is a process for making a turbine blade with thin walls at a lower cost than the single crystal turbine blade. The present invention describes a turbine blade and a process for making the blade. However, the present invention is also intended to be used to produce a stator vane having thin walls as well. The present invention is intended to be used in a large turbine blade such as that used in an industrial gas turbine engine. However, the present invention can be used in any size turbine airfoil where the process of casting cannot be used to form thin walls during the casting process.

Figure 1:
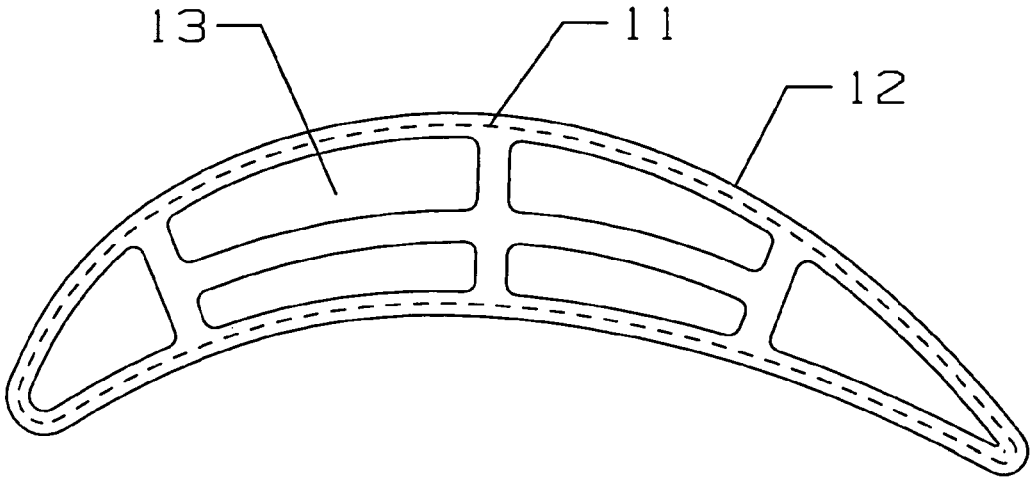
FIG. 1 shows a thin wall turbine blade with a cast wall thickness greater than the design thickness.

FIG. 1 shows a cross section view of a turbine blade in which the designed for airfoil surface 11 is shown as a dashed line. The blade is cast using the equiaxed process with a wall thickness larger than desired and is shown as 12 in the figure. The internal cavities or channels 13 are shown and are formed during the casting process. Any arrangement of cooling channels can be formed within the cast blade without departing from the scope of the present invention. The blade wall is cast to be thick enough such that the core shift during the casting process will still provide a wall thickness at least as thick as the designed for thickness 11 of the finished blade. The blade is cast from a nickel based super alloy of other material in which these turbine blades are made from.

Figure 2:
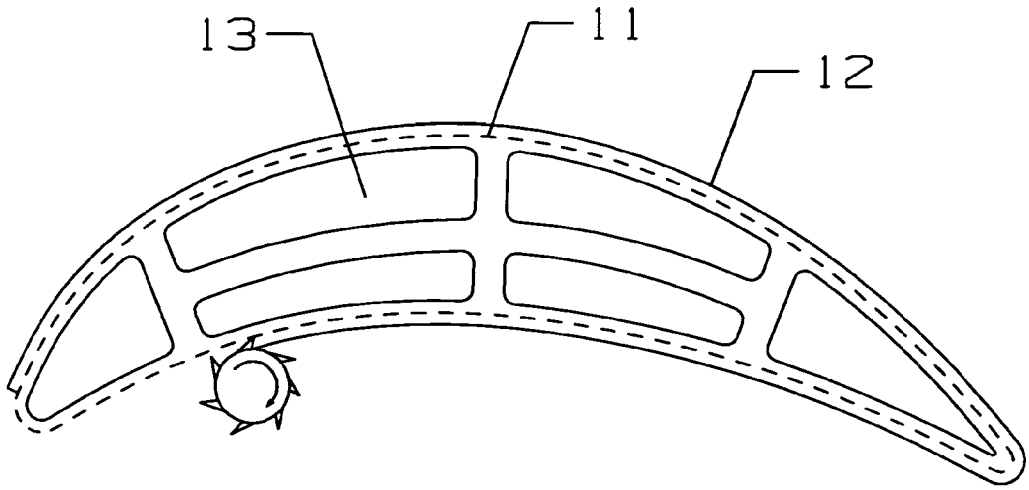
FIG. 2 shows a thin wall blade with part of the thicker wall being removed by a machining process.
Figure 3:
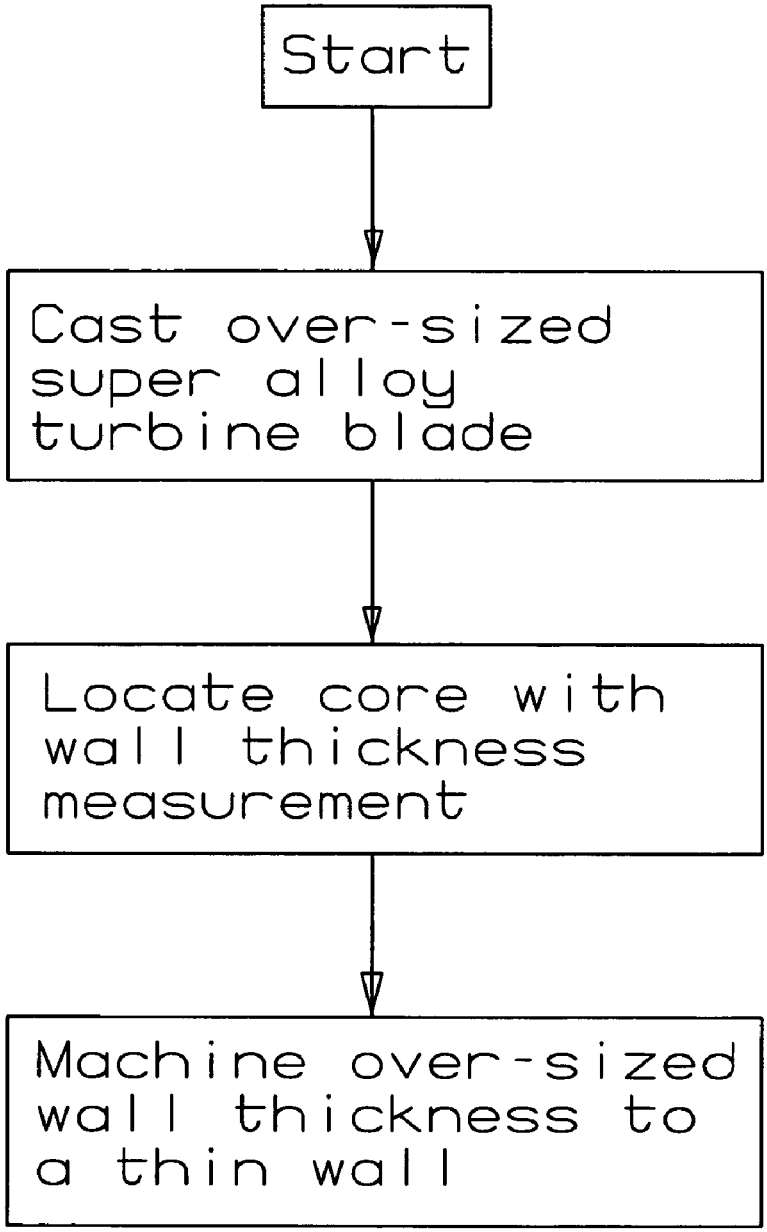
FIG. 3 shows a flow chart of the process for manufacturing the thin wall turbine blade of the present invention.

During the lost wax casting process, the cores used to form the internal passages or channels can sometimes move slightly. This would result in a wall thickness being either too thick or too thin. After the blade has been cast, a process is used to measure the actual cast wall thickness at all points over the blade that is to be machined later. A wall thickness measurement using a sonic or eddy current process can be used to measure the wall thickness around the blade. This measurement is used to control the machining process that will remove enough material from the thicker cast blade such that the thin wall blade is formed. FIG. 2 shows the cast blade with the thicker wall surface 12 represented as a dashed line in this figure. A cutting process is used to remove material down to the point where the designed for thin wall surface is. This machining process is performed over the entire blade wall surface in order to produce a single piece turbine blade with a thin wall surface. The blade machining process could be any machining processes that can remove super alloy material such as grinding, EDM or high speed milling. The machining of the thick walls of the cast blade must be very precise in order to reduce the wall thickness to the desired thin wall level. The tolerances for the blade wall thickness are about +/−0.0020 inches.

We claim:

1. A process of manufacturing a single piece thin walled turbine blade of a last stage of an industrial gas turbine engine comprising the steps of:

casting the last stage industrial engine turbine blade as a single piece with the wall thickness greater than a design thinness such that core shifting is accounted for; and, machining the entire airfoil wall down to the design thinness.

2. The process of manufacturing the turbine blade of claim 1, and further comprising the step of:

casting the last stage industrial engine turbine blade using a lost wax process.

3. The process of manufacturing the turbine blade of claim 1, and further comprising the step of:

casting the last stage industrial engine turbine blade from a super alloy material with an equiaxed grain structure.

4. The process of manufacturing the turbine blade of claim 3, and further comprising the step of:

casting the last stage industrial engine turbine blade from a nickel based super alloy material.

5. The process of manufacturing the turbine blade of claim 1, and further comprising the steps of:

prior to machining the last stage industrial engine turbine blade, locating the core with a wall thickness measurement in order to determine how much material to remove from the wall.

6. The process of manufacturing the turbine blade of claim 5, and further comprising the steps of:

the step of locating the core wall thickness measurement includes performing a sonic scan of the wall.

7. A thin wall last stage industrial engine turbine blade used in a gas turbine engine made from the process of claim 1.

8. A method of forming a large turbine rotor blade used in an industrial gas turbine engine comprising the steps of:

casting a single piece large turbine rotor blade for an industrial gas turbine engine using a ceramic core in an investment casting process; and, machining the entire blade to a wall thickness of less than what can be cast using the ceramic core in the investment casting process.

9. The method of forming a large turbine rotor blade of claim 8, and further comprising the step of:

machining the blade with a wall thickness of less than or equal to 0.030 inches.

10. The method of forming a large turbine rotor blade of claim 8, and further comprising the step of:

casting the blade as a last stage turbine blade.

11. The method of forming a large turbine rotor blade of claim 8, and further comprising the step of:

casting the turbine blade from a super alloy material with an equiaxed grain structure.

* * * * *